US006622589B1

(12) United States Patent
Pino et al.

(10) Patent No.: US 6,622,589 B1
(45) Date of Patent: Sep. 23, 2003

(54) MANUAL CONTROL APPARATUS

(75) Inventors: Thomas J. Pino, Lake Worth, FL (US); Daniel U. Johnston, Nokomis, FL (US)

(73) Assignee: Aptek Williams, Inc., Sarasota, FL (US)

( * ) Notice: Subject to any disclaimer, the term of this patent is extended or adjusted under 35 U.S.C. 154(b) by 64 days.

(21) Appl. No.: 09/625,882

(22) Filed: Jul. 26, 2000

Related U.S. Application Data

(63) Continuation-in-part of application No. 09/443,956, filed on Nov. 19, 1999, now Pat. No. 6,580,352.

(51) Int. Cl.[7] ..... G05G 1/14

(52) U.S. Cl. ..... 74/513; 74/512; 188/73.31; 338/162

(58) Field of Search ..... 74/512, 513, 560; 188/73.31; 338/162

(56) References Cited

U.S. PATENT DOCUMENTS

| | | | | |
|---|---|---|---|---|
| 4,430,634 | A | 2/1984 | Hufford et al. | |
| 4,621,250 | A | 11/1986 | Echasseriau et al. | |
| 4,812,803 | A | 3/1989 | Hochholzer | |
| 4,944,269 | A | 7/1990 | Imoehl | |
| 4,958,607 | A | 9/1990 | Lundberg | |
| 4,976,166 | A | 12/1990 | Davis et al. | |
| 5,016,586 | A | 5/1991 | Imamura et al. | |
| 5,133,321 | A | 7/1992 | Hering et al. | |
| RE34,302 | E | 7/1993 | Imoehl | |
| 5,233,882 | A | 8/1993 | Byram et al. | |
| 5,241,936 | A | 9/1993 | Byler et al. | |
| 5,295,409 | A * | 3/1994 | Byram et al. | 74/514 |
| RE34,574 | E | 4/1994 | Imoehl | |
| 5,321,980 | A * | 6/1994 | Hering et al. | 73/118.1 |
| 5,385,068 | A | 1/1995 | White et al. | |
| 5,408,899 | A | 4/1995 | Stewart | |
| 5,415,144 | A | 5/1995 | Hardin et al. | |
| 5,416,295 | A | 5/1995 | White et al. | |
| 5,509,396 | A | 4/1996 | Tamaki | |
| 5,529,296 | A | 6/1996 | Kato et al. | |
| 5,661,890 | A | 9/1997 | Pfaffenberger | |
| 5,697,260 | A | 12/1997 | Rixon et al. | |

(List continued on next page.)

FOREIGN PATENT DOCUMENTS

| | | | | |
|---|---|---|---|---|
| DE | 197 20 390 | | 11/1998 | |
| EP | 0 748 713 | A2 * | 12/1996 | 74/512 |
| EP | 0 963 871 | A2 | 12/1999 | |
| GB | 2338774 | A * | 12/1999 | 74/512 |
| JP | 11-59220 | * | 3/1999 | 74/512 |
| JP | 11-264710 | * | 9/1999 | 74/512 |
| JP | 2001-260697 | * | 9/2001 | 74/512 |
| JP | 2002-79844 | * | 3/2002 | 74/512 |
| WO | WO 97/30863 | * | 8/1997 | 74/512 |

OTHER PUBLICATIONS

International Search Report dated Aug. 2, 2001, for corresponding international application PCT/US00/42191.

*Primary Examiner*—Vinh T. Luong
(74) *Attorney, Agent, or Firm*—Brinks Hofer Gilson & Lione

(57) ABSTRACT

A manual control apparatus, such as a control pedal, is configured for drive-by-wire control systems, and similar applications. In one aspect, the manual control apparatus comprises a hysteresis mechanism that provides more precise and ma controllable hysteresis than previous mechanisms. In a further aspect, the manual control apparatus comprises an angular position sensor, and the angular position sensor housing may comprise abutments that reduce variation in the sensor. In a still further aspect, the manual control apparatus comprises a stop pin that regulates the position of a rotatable member relative to the position sensor with less variation. The stop pin may also be used as a single fastener that holds the manual control apparatus together.

19 Claims, 12 Drawing Sheets

U.S. PATENT DOCUMENTS 5,768,946 A 6/1998 Fromer et al.
5,773,820 A 6/1998 Osajda et al.
5,812,050 A 9/1998 Figgins
5,868,040 A 2/1999 Papenhagen et al.
5,886,490 A 3/1999 Miller et al.
5,934,152 A 8/1999 Aschoff et al.
5,937,707 A 8/1999 Rixon et al.
5,964,125 A 10/1999 Rixon et al.
6,070,490 A * 6/2000 Aschoff et al. ..... 74/513
6,089,120 A * 7/2000 Lochle et al. ..... 74/514
6,158,299 A * 12/2000 Czajkowski ..... 74/513
6,223,865 B1 * 5/2001 Lang et al. ..... 188/73.31
6,311,578 B1 * 11/2001 Kohlen ..... 74/513
6,426,619 B1 * 7/2002 Pfaffenberger et al. .. 324/207.2
2002/0100341 A1 * 8/2002 Kumamoto et al. ..... 74/512

* cited by examiner

MANUAL CONTROL APPARATUS

CROSS-REFERENCE

This application is a continuation-in-part of U.S. application Ser. No. 09/443,956, filed Nov. 19, 1999, which is herein incorporated by reference.

BACKGROUND

The invention relates to a manual control apparatus, such as a control pedal for drive-by-wire control systems, and similar applications.

Manual control apparatuses, such as throttle control pedals for drive-by-wire throttle control systems, are known in the art. Due to the fact that such pedals eliminate the mechanical linkage to the carburetor on an engine, hysteresis is often added to replicate the "feel" of a pedal having a mechanical linkage. In particular, it is desirable for a rotatable member, for example a pedal, to generate an increased resistance during depression, and an ability stay at a fixed position with reduced force in order to avoid operator fatigue. This is typically provided by introducing a deliberate amount of frictional resistance to movement at one or more locations in the pedal mechanism. A similar effect may also be desirable in other manual control apparatuses such as a hand operated throttle, or a brake control pedal for a drive-by-wire control system, without limitation.

Although manual control apparatuses having hysteresis are known in the art, a desirable apparatus would have more precisely controlled hysteresis than is presently available. In addition, a desirable apparatus would also be light in weight, simple in manufacture, and simple in assembly with as few components as possible.

In addition to hysteresis, manual control apparatuses typically have a rotation sensor that indicates rotation of the rotatable member, for example a pedal, relative to a fixed point, such as a base to which the pedal is mounted. Precise registration of the rotatable member relative to the fixed point at a particular angle is important for both calibration, and for repeatability from apparatus to apparatus. In a throttle control pedal, the angle of rotation of the pedal is typically measured from the idle position. However, tolerance stack-up can cause a significant variation within a group of apparatuses. Tolerance stack-up and manufacturing variation may also cause significant variation within the rotation sensor. Therefore, a desirable apparatus would provide reduced variation in the rotation sensor system.

SUMMARY

According to an aspect of the invention, a manual control apparatus is provided with a spring that biases a rotatable member relative to a base, and the body of the spring is forced against a friction element. The friction element rides upon a curved friction surface and is directly coupled to the rotatable member.

According to a further aspect of the invention, a manual control apparatus is provided having an angular position sensor with a housing and a pivot mounted to the housing. A rotatable member is coupled to the pivot and the angular position sensor indicates an angular position of the rotatable member. A stop pin is mounted on the housing and the rotatable member rests on the stop pin when in the idle position.

According to a still further aspect of the invention, a manual control apparatus is provided having an angular position sensor comprising a housing mounted to a base. The housing is coupled to a pivot to sense rotation thereof. The housing comprises a first abutment that defines a first datum plane perpendicular to an axis of rotation of the pivot, and a second abutment that defines a second datum plane perpendicular to the axis of rotation. A rotor within the housing is coupled to the pivot shaft, and a sensing element cooperates with the rotor to indicate an angular position thereof relative to the base. The sensing element rests upon the first abutment, and a rotor spring biases the rotor against the second abutment.

According to a still further aspect of the invention, a manual control apparatus is provided, comprising an angular position sensor comprising a housing coupled to a pivot to sense rotation thereof. The housing comprises a pair of opposing bosses that are received within recesses in a base. An idle stop is mounted to the housing and the base thereby retaining the bosses within the recesses. The housing is restrained within the base using the idle stop as a single fastener.

A method is also provided for applying hysteresis to a manual control apparatus by rotating a rotatable member in unison with a friction shoe resting on a curved friction surface, the friction shoe being directly coupled to the rotatable member, thereby generating frictional resistance between the friction shoe and friction surface.

The manual control apparatus of the invention is particularly well suited for use with a drive-by-wire system wherein a direct mechanical linkage to an engine throttle or brake hydraulic system, for example, is eliminated.

DETAILED DESCRIPTION OF THE PREFERRED EMBODIMENTS OF THE INVENTION

Various aspects of the invention are presented in FIGS. 1–25, which are not drawn to scale, and wherein like components in the numerous views are numbered alike. As used herein, the term "manual" refers to operation by hand, foot, or any other body part.

Figure 1:
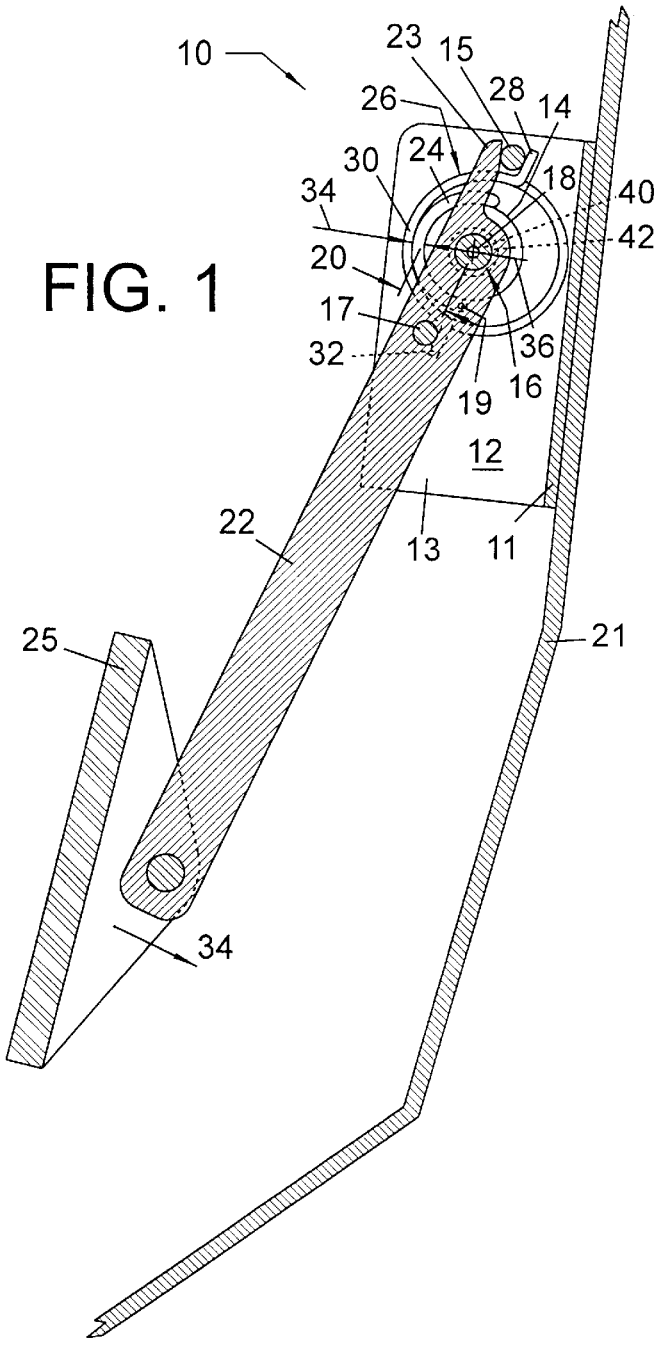
FIG. 1 presents a side cross-section view of a manual control apparatus according to an aspect of the invention, taken along line 1—1 of FIG. 2.
Figure 2:
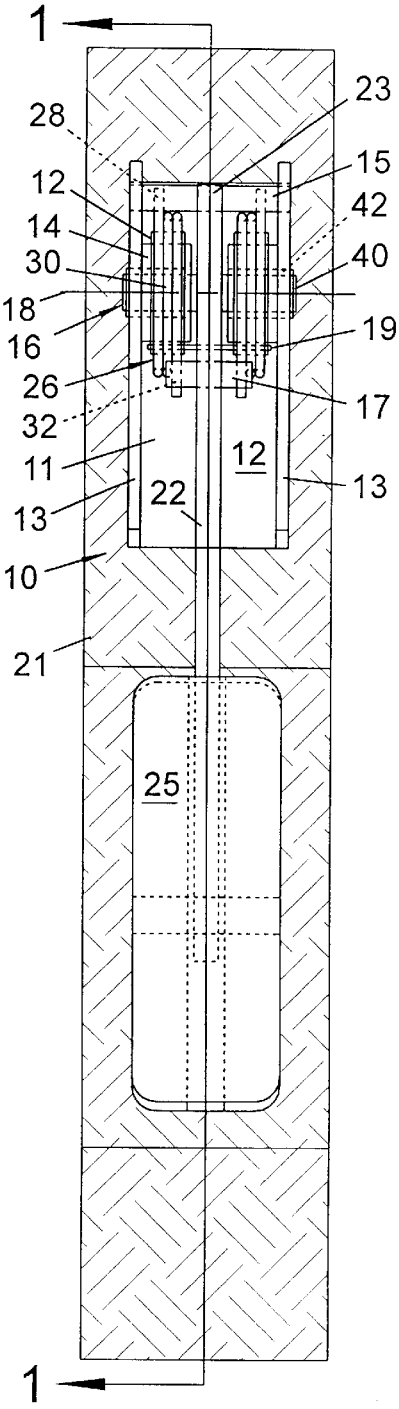
FIG. 2 is a front view of a manual control apparatus according to an aspect of the invention.

Referring now specifically to FIGS. 1 and 2, a manual control apparatus 10 with hysteresis is presented according to one aspect of the invention, in this example, a throttle control pedal for a truck or automobile is shown. FIG. 2 is a front view of the pedal, and FIG. 1 is a cross-sectional side view taken along line 1—1 of FIG. 2. The throttle control pedal 10 is shown mounted to a suitable structure of a motorized vehicle, such as a passenger compartment firewall 21.

The throttle control pedal 10 comprises a base 12 having a curved friction surface 14. A pivot 16 is mounted to the base 12, which defines an axis of rotation 18 spaced from the curved friction surface 14, as indicated at 20. A rotatable member 22, in this example a lever, is mounted to the pivot 16, wherein the rotatable member 22 is rotatable around the axis of rotation 18 relative to the base 12. A friction element 24 is mounted to rotate with the rotatable member 22, spaced from the axis of rotation 18, and forcible against the curved friction surface 14.

The friction element 24 is directly coupled to the rotatable member 22. As used herein, the term "directly coupled" means that the friction element is mechanically linked (as opposed to frictional coupling alone) to the rotatable member for rotation therewith so that the two rotate in unison. This is in contrast to certain prior art hysteresis mechanisms that implement only frictional coupling with the spring to induce movement of the friction element. The present invention offers a distinct advantage in that the friction element is directly forced to move with the rotatable member 22 rather than relying solely upon the presence of sufficient frictional force at the spring/friction element interface to move the friction element.

The rotatable member is biased by a spring 26 having a first end 28, a second end 32, and an intermediate portion 30 between the first end 28 and the second end 32. The first end 28 is coupled to the base 12, and the second end 32 is coupled to the rotatable member 22. Rotation of the rotatable member 22, as indicated by arrow 34, forces the intermediate portion 30 against the friction element 24, as indicated by arrow 36, resisted by the curved friction surface 14, as indicated by the opposing arrow 38, thereby generating a frictional resistance to the rotation. At least two springs 26, two friction elements 24, and two cylindrical friction surfaces 14 are preferably provided for redundancy.

The pivot 16 comprises a shaft 40 received within a bearing 42. The bearing 42 is mounted to the base 12 and the shaft 40 is fixed to the rotatable member 22. The bearing 42 may be any type of bearing suitable for use in a throttle control pedal including, without limitation, bushings, ball bearings, needle bearings, and roller bearings.

The base 12 may be configured in a variety of ways. For example, the base 12 may comprise a bottom panel 11 and two side flanges 13 extending upward from the bottom panel 11. A stop pin 15 may be attached to the base 12 that performs multiple functions. First, the first end 28 of the spring 26 rests against it, thus restraining the first end 28 against rotation. Second, the stop pin 15 acts as an idle stop for the rotatable member 22. As will be described more fully, the stop pin may also be used to provide accurate registration of the rotatable member 22 relative to a with a position sensor with less variation, and it may also be used as a single fastener that assembles the manual control apparatus 10.

The rotatable member 22 may comprise a finger 23 that engages the stop pin 15 at the idle position thus preventing further rotation. The second end 32 may be fixed to the rotatable member 22 by a second pin 17. The friction element 24 may be fixed to the rotatable member 22 by a third pin 19 that allows the friction element to rotate relative to the rotatable member 22. The pin connection causes essentially all of the load 34 induced by the intermediate portion 30 to be transferred to the cylindrical friction surface 14, although this is not strictly necessary in the practice of the invention as long as a substantial portion of the load 34 is transferred. A footrest 25, or pedal pad, may be pivotally mounted to the end of the rotatable member 22, and may be spring biased against the rotatable member 22 if desired. Numerous variations in such minutia are possible and evident in light of the description provided herein.

Figure 3:
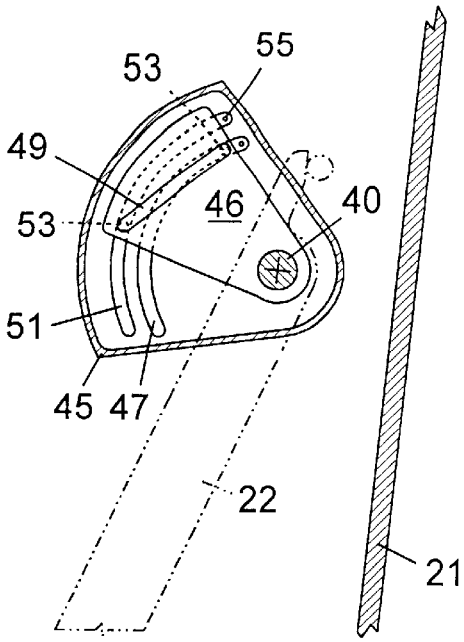
FIG. 3 is a side cross-sectional view of a manual control apparatus according to a further aspect of the invention, taken along line 3—3 of FIG. 4.
Figure 4:
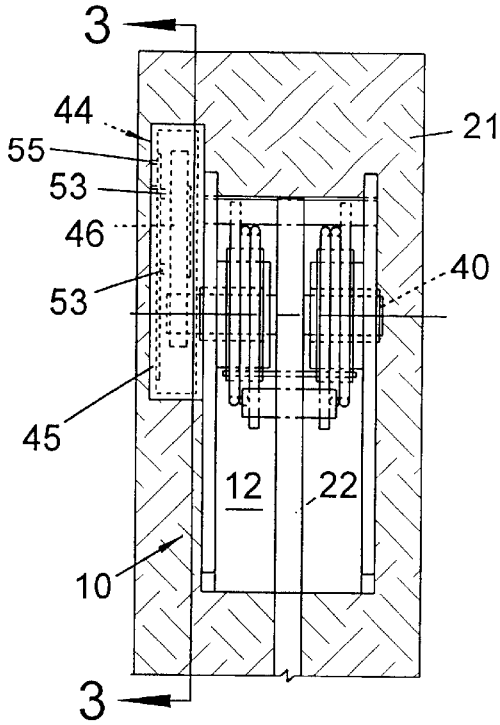
FIG. 4 is a front view of a manual control apparatus according to an aspect of the invention.

Referring now to FIGS. 3 and 4, an angular position sensor 44 may be mounted to the base 12 that senses angular position of the shaft 40. FIG. 4 is a front view of the upper portion of the throttle control pedal 10, and FIG. 3 is a side cross-sectional view taken along line 3—3 of FIG. 4. The various components of the throttle control pedal 10 are the same as presented in FIGS. 1 and 2, and numbering is not repeated here for the sake of clarity, unless needed for reference. Various angular position sensors may be employed in the practice of the invention. In the example presented, the angular position sensor 44 comprises a rotor 46 fixed to the shaft 40. In FIG. 3, the rotatable member 22 is shown in phantom for reference purposes.

In the example presented, the angular position sensor 44 is a simple potentiometer. The position sensor 44 further comprises a housing 45 that encloses the rotor 46, and an opposing pair of conductive paths 47 and 51. The rotor 46 is provided with a pair of spring biased electrical brushes 53 electrically clamped to each other by a shunt 49. The brushes 53 and shunt 49 provide a conductive path in combination with the conductive traces 47 and 51. Rotating the rotatable member 22 rotates the rotor 46 which increases the length of the conductive path, and hence the resistance in proportion to the rotation of the rotatable member 22.

A pair of conductive feed-throughs 55 are provided that may be connected to a wiring harness and appropriate electronics for converting the resistance reading to an indication of angular position. Variations are possible, and numerous suitable position sensors 44 are well known in the art. It is not intended to restrict the invention to the simple potentiometer embodiment presented herein. For example, U.S. Pat. No. 5,133,321 to Hering et al. discloses an integrated position and idle control sensor for drive-by-wire pedal assemblies, which is herein incorporated by reference.

Figure 5:
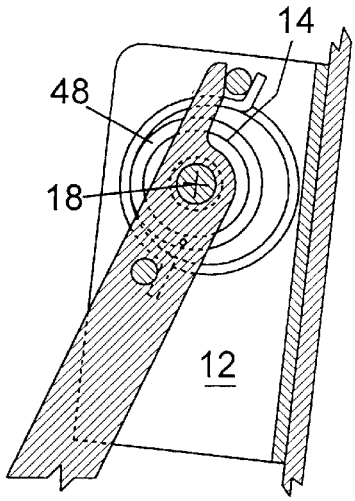
FIG. 5 is a side cross-sectional view of a manual control apparatus according to a further aspect of the invention.

The friction element 24 of FIGS. 1 and 2 is configured as a shoe. It does not encircle the cylindrical friction surface 14. However, the friction element may be configured in other shapes. As presented in FIG. 5, a friction element 48 is presented that is configured as a ring that encircles the curved friction surface 14. Similarly, the curved friction surface 14 may be fully cylindrical about the axis of rotation 18, as shown in FIG. 5, or may be just a sector of a cylinder.

Figure 6:
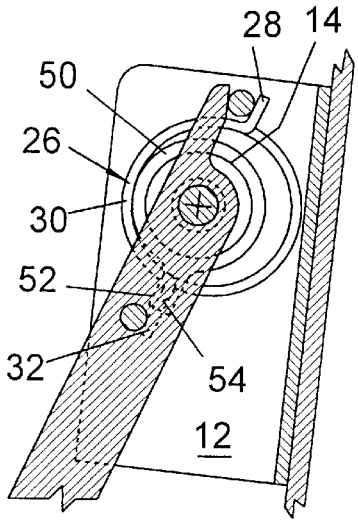
FIG. 6 is a side cross-sectional view of a manual control apparatus according to a further aspect of the invention.

Referring now to FIG. 6, another embodiment is presented that implements a friction element 50, wherein the spring 26 is a torsion spring encircling the axis of rotation 18. The curved friction surface 14 is a cylindrical surface concentric about the axis of rotation 18. The friction element 50 is a ring encircling the curved friction surface 14 and comprises a protuberance 54 having a channel 52 that receives the second end 32 of the spring 26.

Figure 7:
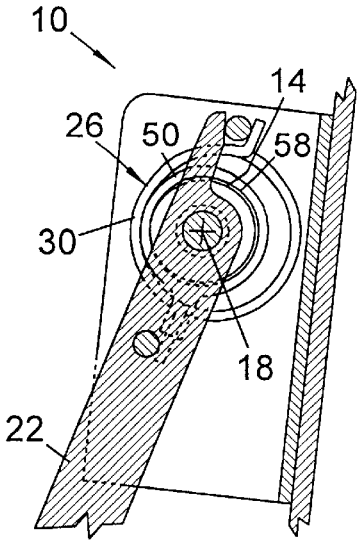
FIG. 7 is a side cross-sectional view of a manual control apparatus according to a further aspect of the invention.

Referring now to FIG. 7, a preferred embodiment is presented that implements the friction element 50, wherein the spring 26 is a torsion spring encircling the friction element 50. The torsion spring is spaced from the friction element 50 except at the intermediate portion 30, wherein the intermediate portion 30 rests upon the friction element 50 supported by the curved friction surface 14. The spring 26 is stressed when the throttle control pedal 10 is assembled such that a preload is exerted upon the friction element 50 at the intermediate portion 30 toward the axis of rotation 18 when the rotatable member 22 is in the idle position, as shown. The spring 26 is eccentrically offset relative to the friction element 50 when installed on the base 12.

The inside diameter of the friction element 50 is larger than the outside diameter of the curved friction surface 14 such that a space 58 is defined therebetween, except that the spring preload deflects the friction element 50 only beneath the intermediate portion 30 of the spring 26 such that it is forced into contact with the curved friction surface 14 beneath the intermediate portion 30. In practice, the inside diameter of the friction element 50 needs to be only slightly larger than the diameter of the curved friction surface such that a frictional resistance to rotation is generated essentially beneath the intermediate portion 30, and not along the entire circumference of the friction surface 14.

This feature, in combination with the spring 26 being spaced from the outside diameter of the friction element 50, except at the intermediate portion 30, generates an essentially pure side load during stroking of the rotatable member 22 directed toward the axis of rotation 18. In such manner, the location where the friction element 50 generates the frictional resistance to rotation and the magnitude of the frictional resistance are precisely controlled.

According to a further aspect of the invention, a method of applying hysteresis to a manual control apparatus is provided, comprising forcing an intermediate portion 30 of a spring 26 against a friction element 24 resting on a curved friction surface 14 that is part of a base 12 by rotating a rotatable member 22 about an axis of rotation 18 and rotating a second end 32 of the spring 26 with the pedal lever, a first end 28 of the spring 26 being coupled to the base 12, the rotatable member 22 being mounted to the base 12 and the friction element being directly coupled to the rotatable member 22.

Figure 8:
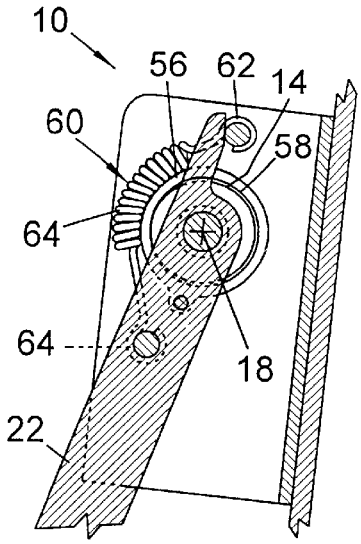
FIG. 8 is a side cross-sectional view of a manual control apparatus according to a further aspect of the invention.

Referring now to FIG. 8, an embodiment is presented identical to FIG. 7, except that the torsion spring 26 is replaced by a linear spring 60 having a first end 62, and intermediate portion 64, and a second end 66. The spring 60 and the intermediate portion 64 function in the same manner previously described in relation to FIG. 7 to provide a side load on the friction element 56, and to resist depression of the rotatable member 22. In this example, friction element 56 comprises a protuberance and pin passing through the protuberance and attached to the rotatable member 22, which directly couples the friction element 56 and the rotatable member 22. Although described with respect to particular embodiments, the concepts described in relation to FIGS. 7 and 8 may be implemented in the other embodiments described herein.

Although described in relation to a rotatable member 22 that is a lever with reference to FIGS. 1–8, any manually rotatable member may be implemented in the practice of the invention with any control apparatus such as a throttle control, a brake control, or other manual control adaptable for use with the invention, without limitation.

Figure 9:
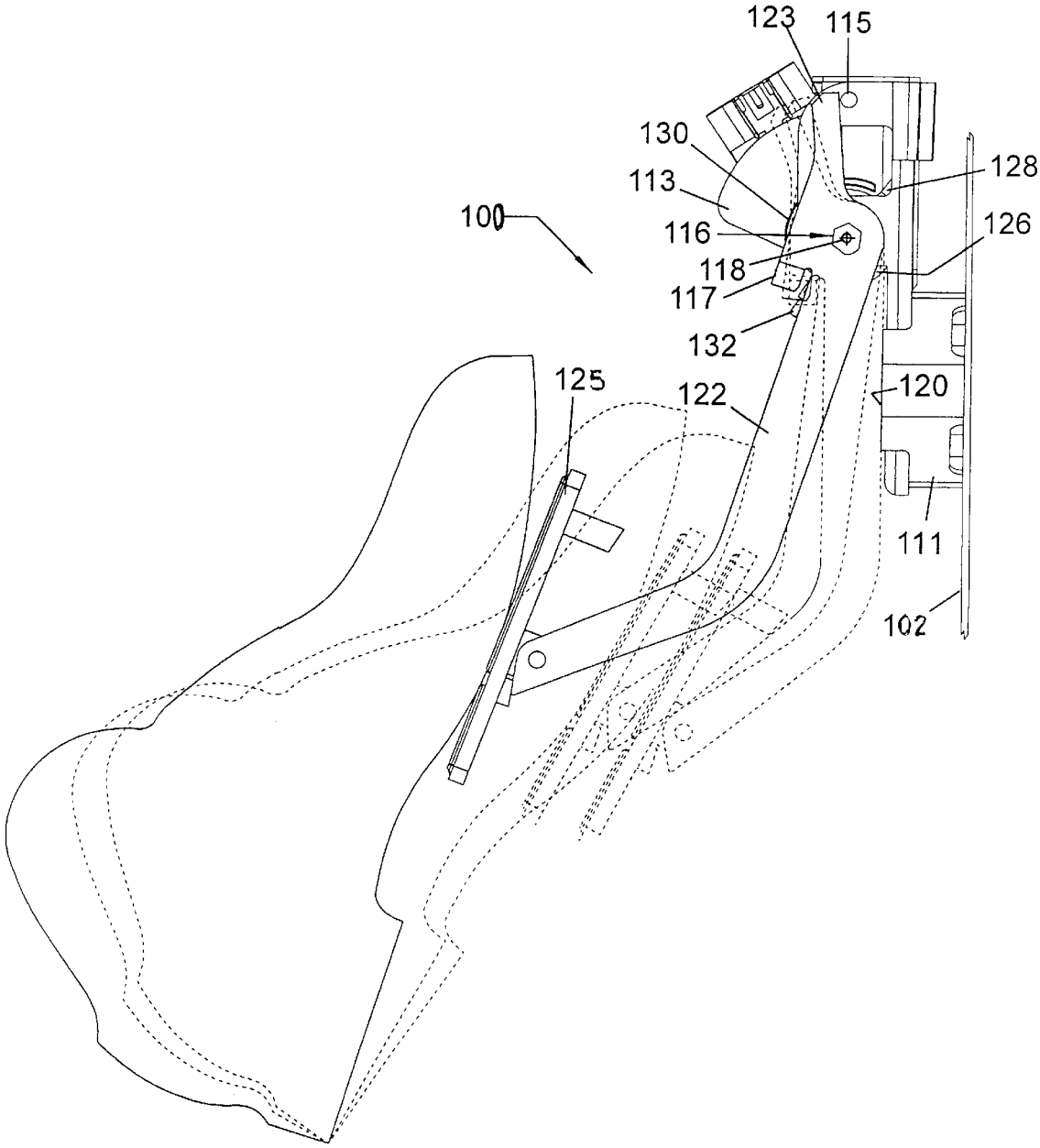
FIG. 9 is a side view of a throttle control pedal according to a further aspect of the invention.
Figure 11:
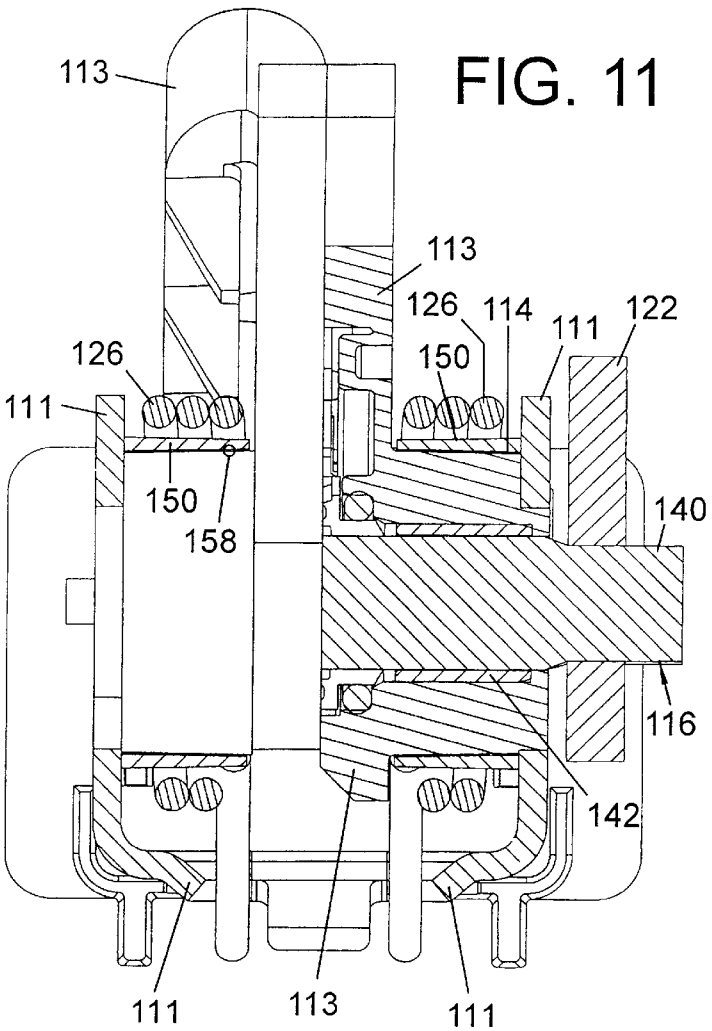
FIG. 11 is an enlarged front view of an upper portion of the FIG. 9 throttle control pedal with partial cross-sections.
Figure 10:
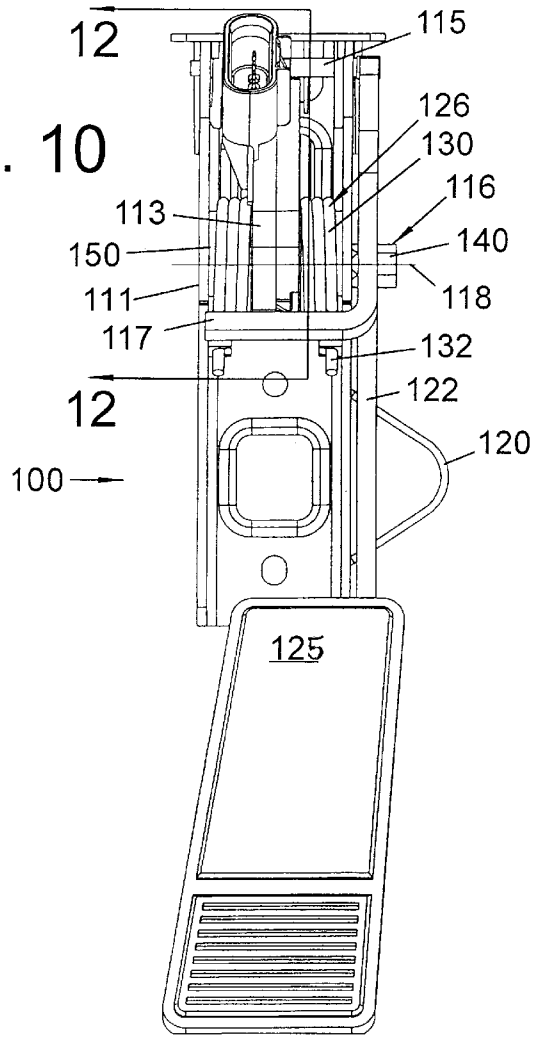
FIG. 10 is a front view of the FIG. 9 throttle control pedal.

Referring now to FIGS. 9 and 10, side and front views, respectively, of a throttle control pedal 100 with hysteresis are presented according to a further aspect of the invention. FIG. 11 presents an enlarged view of the upper portion of FIG. 9 with partial cross-sections of selected portions. The throttle control pedal 100 is shown mounted to a suitable structure of a motorized vehicle, such as a passenger compartment firewall 102.

Referring to FIGS. 9–11, the throttle control pedal 100 comprises a base 112 comprising a frame 111 and a housing 113. The housing 113 has a curved friction surface 114, as shown in FIG. 11. As used herein, the term "base" is intended to mean a non-rotating structure to which the lever is coupled, and any non-rotating structure mounted to the base. Thus, the housing 113 and frame 111 are both members of the base 112.

A pivot 116 is mounted to the base 112 that defines an axis of rotation 118 spaced from the curved friction surface 114. The curved friction surface 114 is cylindrical about the axis of rotation 118, and the pivot 116 comprises a shaft 140 received within a bearing 142 mounted to the housing 113. A lever 122 is fixed to the shaft 140. A footrest 125 is pivotally attached to the lever 122. A friction ring 150 is mounted to rotate with the lever 122, spaced from the axis of rotation 118, encircling the curved friction surface 114 and forcible against the curved friction surface 114.

A torsion spring 126 encircles the friction ring 150. The torsion spring has a first end 128, a second end 132, and an intermediate portion 130 between the first end 128 and the second end 132. The first end 128 is fixed to the base 112 and the second end 132 is fixed to the lever 122. Rotation of the lever 122 forces the intermediate portion 130 against the friction ring 150 resisted by the curved friction surface 114 thereby generating a frictional resistance to the rotation through the friction ring 150. Thus, the principle of operation of throttle control pedal 100 is identical to that of the throttle control pedal 10 of FIGS. 1 and 2.

As previously described in relation to FIG. 7, a small space 158 is defined between the friction ring 150 and the curved friction surface 114, except beneath the intermediate portion 130 of the spring 126 where the friction ring 150 rests upon the curved friction surface 114 due to preload in the spring 126.

A stop pin 115 is mounted to the base 112 and the lever 122 is provided with a finger 123 that engages the stop pin 115 in the idle position. The lever 122 also comprises a cross bar 117 that engages the second end 132 of the spring 126. The base 12 also comprises a lower stop 120 that stops further pivoting of the lever 122 at full depression.

Figure 12:
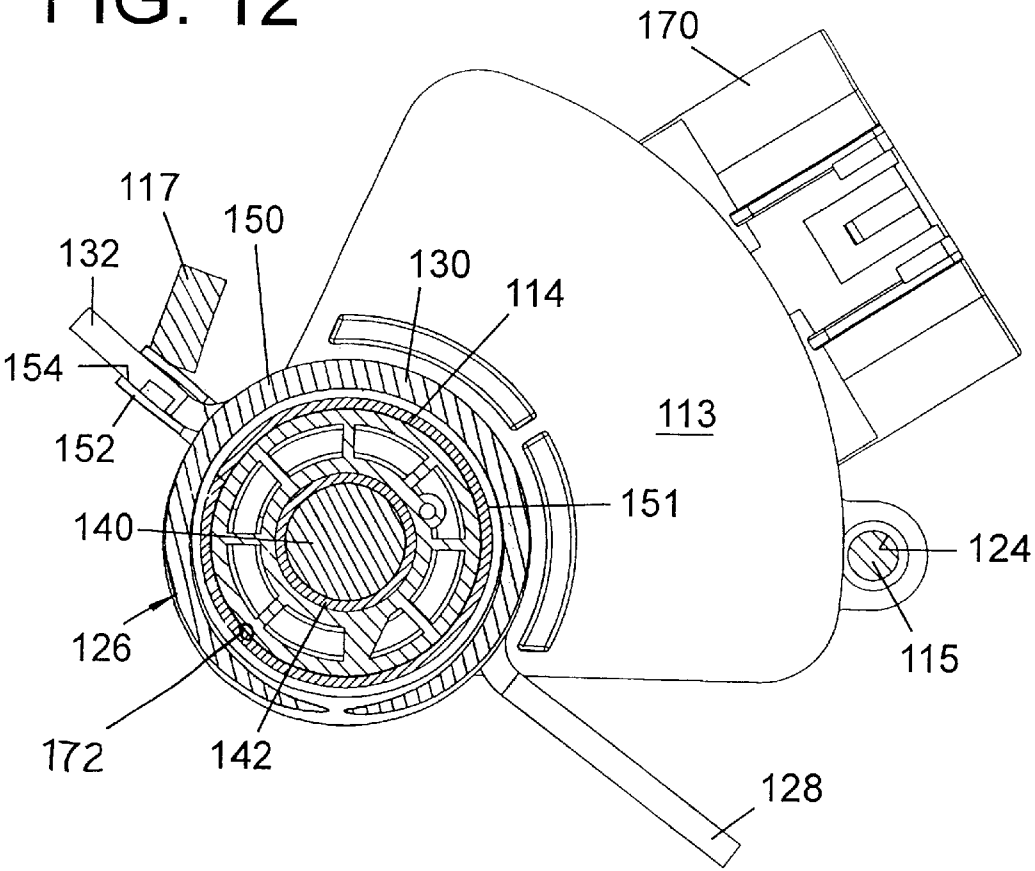
FIG. 12 is an enlarged side view of an upper portion of the FIG. 9 throttle control pedal with partial cross-sections taken along line 12—12 of FIG. 10.

Referring now to FIG. 12, a side cross-sectional view of the upper part of the throttle control pedal 100 through the housing 113 taken along line 12—12 of FIG. 10 is presented. The friction ring 150 comprises an outside cylindrical surface 151 and a protuberance 152 extending therefrom. The protuberance 152 has a channel 154 that receives the second end 132 of spring 126. The cross bar 117 is shown for reference, and preferably rides on the protuberance 152. Preferably, the protuberance 152 and cross bar 117 rotate concentric with the axis of rotation 118 so that the cross bar 117 does not slide on the surface of the protuberance while the lever 122 is depressed.

Figure 13:
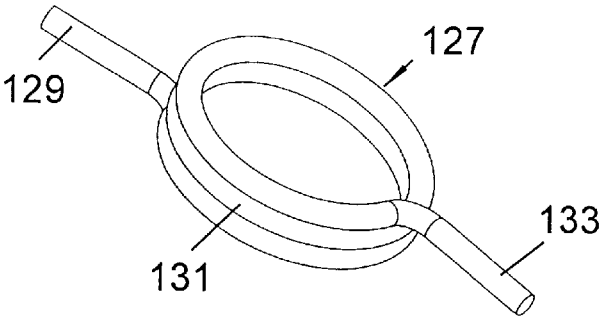
FIG. 13 is a perspective view of a spring according to an aspect of the invention.
Figure 14:
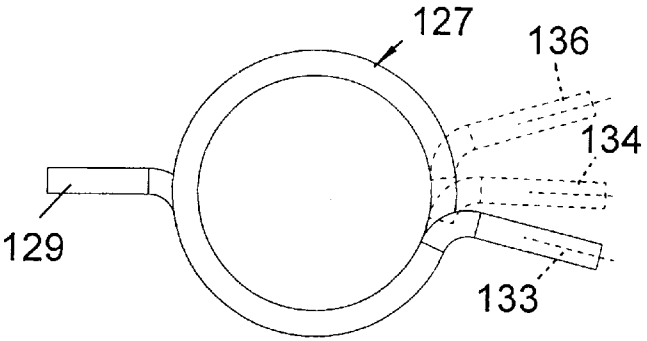
FIG. 14 is a top plan view of the FIG. 13 spring.

Referring now to FIG. 13, a perspective view of a spring 127 that may be used in the practice of the invention is presented. Spring 127 comprises a first end 129, an intermediate portion 131, and a second end 133, and is identical to spring 126 except the first end 129 is shorter than the first end 128 of spring 126. Such variations may be made for particular applications without departing from the invention. Referring now to FIG. 13, a top plan view of the spring 127 is presented in an unstressed state. The spring 127 is preloaded when installed with the pedal 122 in the idle position, as indicated by the phantom position 134 of the second spring end 133. Full load is indicated by phantom position 136 of the second spring end 133.

Figure 15:
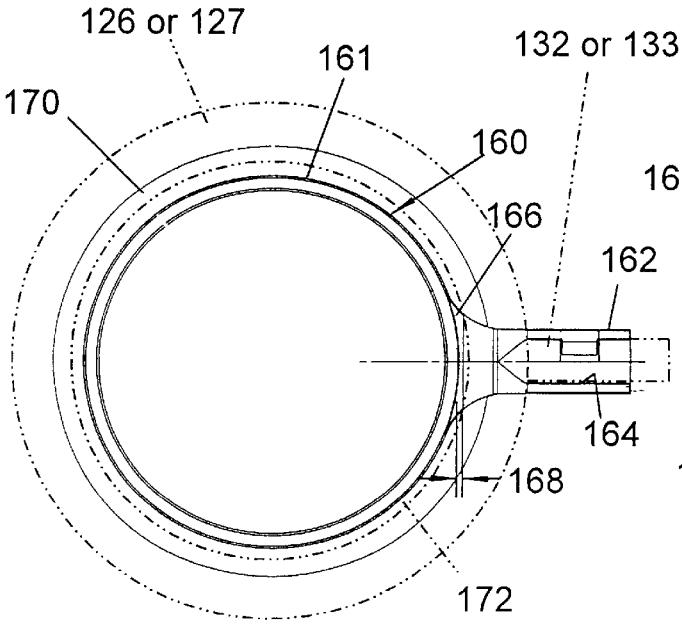
FIG. 15 is a top plan view of friction element according to an aspect of the invention.
Figure 16:
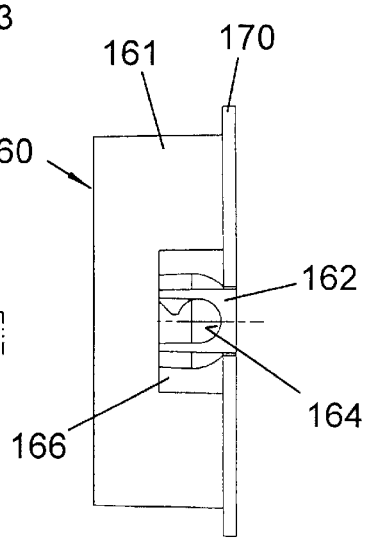
FIG. 16 is a side elevational view of the FIG. 15 friction element.
Figure 17:
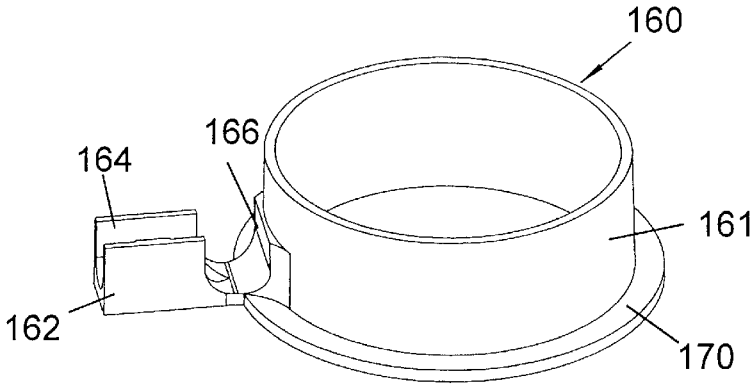
FIG. 17 is a perspective view of the FIG. 15 friction element.

Referring now to FIGS. 15, 16 and 17, a top plan view, a side elevational view, and a perspective view, respectively, are presented of a friction element 160 configured as a ring according to a further aspect of the invention. The friction element 160 comprises an outside surface 161, and a protuberance 162 extending from the outside cylindrical surface 161 having a channel 164 that receives a spring end, as previously described herein. According to a further aspect of the invention, the outside cylindrical surface 161 comprises a spacer 166 having a predetermined thickness 168 above the surface 161, and the protuberance 162 extends from the spacer 166. The protuberance 162 and the spacer 166 couple the torsion spring 126 or 127 (shown in phantom) relative to the friction ring or element 160 such that in an unstressed state a space is defined between the torsion spring and the friction ring encircling the friction ring and interrupted by the spacer. The second end 132 or 133 (shown in phantom) is received within the channel 164. The friction element 160 may also comprise a rim 170 extending outwardly from the outside cylindrical surface 161. Upon installing the friction element 160 and spring assembly into a pedal assembly 10 at an idle position, preloads the spring, and causes the intermediate portion of the spring to be forced into contact with the friction ring 160, as previously described, thus interrupting the space 172 at another location.

Figures 18, 19:
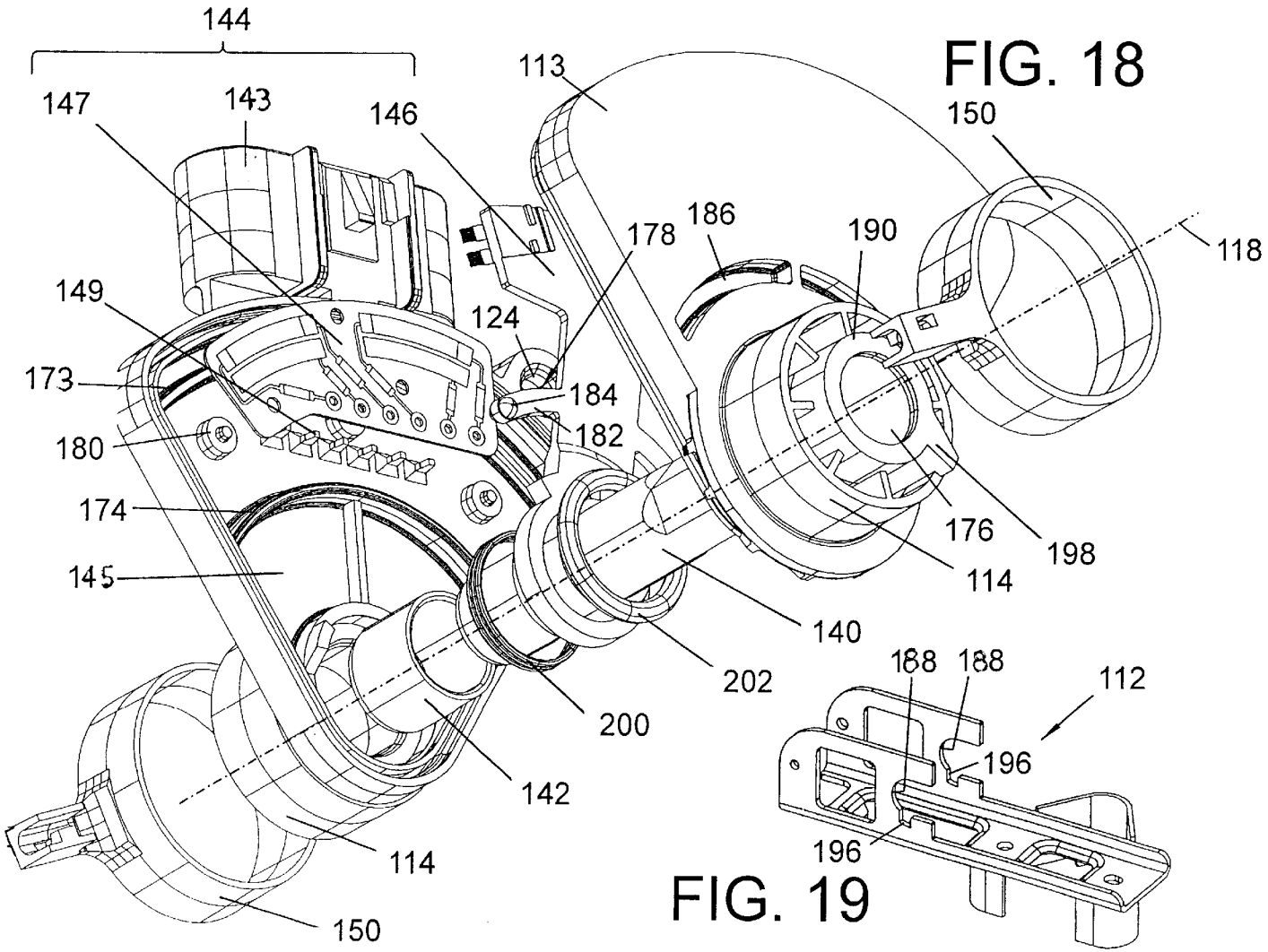
FIG. 18 is an exploded perspective view of a housing according to an aspect of the invention.
FIG. 19 is a perspective view of a base that is employed with the housing of FIG. 18.

Referring now to FIG. 18, an exploded perspective view of the housing 145 is presented, along with components attached to the housing 145. The housing 145 includes an angular position sensor 144 that is coupled to the pivot to sense rotation thereof. In the example presented, the angular position sensor comprises a rotor 146 coupled to the shaft 140, and a sensing element 147 fixed to the housing. Terminals 149 are provided that mate with the sensing element, and that are connected to an external electrical connector 143 for connection to a wire harness. An internal spring 200 and an O-ring may 202 may also be provided.

The housing 145 comprises a first abutment 173 that defines a first datum plane perpendicular to the axis of rotation 118 and a second abutment 174 that defines a second datum plane perpendicular to the axis of rotation 118. The pivot shaft is received within an opening 176 in the housing 145. The sensing element 147 cooperates with the rotor 146 to indicate an angular position thereof relative to the base 112.

The sensing element 147 rests upon the first abutment 173 and a rotor spring 178 biases the rotor 146 against the second abutment 174. Thus, the sensing element 147 and the rotor 146 are accurately positioned relative to each other, and the positioning is not dependent on accurately joining the first and second halves of the housing 145.

In the example presented, the first and second abutments 173 and 174 are curved ridges molded in the left half of the housing 145. One or more further structures may be added, such as a nipple 180 that position the sensing element 147 within the first datum plane. If the axis of rotation 118 is viewed as a Z-axis, then the X and Y axes lie in the first datum plane, as determined by the first abutment 172, and the nipples 180 position the sensing element relative to the X and Y axes. Thus, the sensing element 180 may be accurately positioned in all three spatial dimensions relative to the rotor 146. Innumerable variations are possible in light of the description provided herein.

In the example presented, the rotor spring 178 comprises at least one tab 182 that is integral with the rotor 146. Two opposing tabs 182 are preferably provided. The tab 182 bears against the right half of housing 145 and biases the rotor 146 against the second abutment 174. The tab 182 may be provided with a spherical bump 184 that focuses the spring load onto a predefined area of the housing 145. The housing 145 may also comprise a third abutment, the backside of which is indicated at 186, that the rotor spring 178 bears against. In the example presented, the third abutment 186 is a curved ridge and serves as a track upon which the spherical bump 184 rides. Innumerable variations are possible in light of the description provided herein.

Referring now to FIG. 19, a perspective view of the base 112 is provided. According to a further aspect of the invention, the base 112 comprises a pair of recesses 188. The housing 145 comprises a pair of opposing bosses 190 (FIG. 18) that are received within the recesses 188. The stop pin 115 couples the housing to the base thereby retaining the bosses 190 within the recesses 188. The housing 145 is provided with a stop pin hole 124 that receives the stop pin 115.

Figure 20:
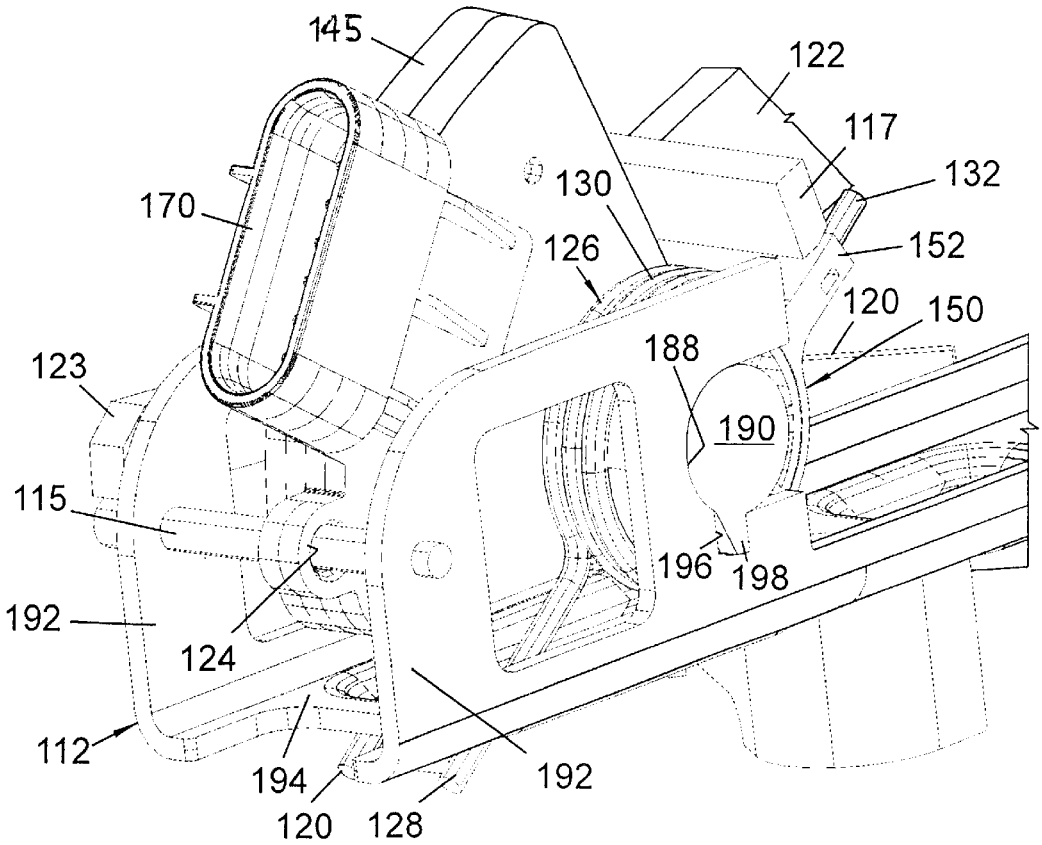
FIG. 20 is a perspective view of the backside of an upper portion of the FIG. 9 throttle control assembly.

This is further illustrated in FIG. 20 wherein a perspective view is presented of the backside of the upper portion of the throttle control pedal 100 of FIG. 9. The bosses 190 closely conform to the recesses 188, which open in the same direction. The stop pin 115 is located on a side opposite from that direction. In the embodiment presented, the recesses 188 are C-shaped and formed in a pair of side flanges 192 that extend upward from a bottom panel 194, and the bosses 190 are cylindrical. The housing 145 is located between the side flanges 192. With this arrangement, the housing 145 is captive in all directions within the bracket 112. The stop pin 115 serves as a single fastener that holds the assembly together.

Figure 21:
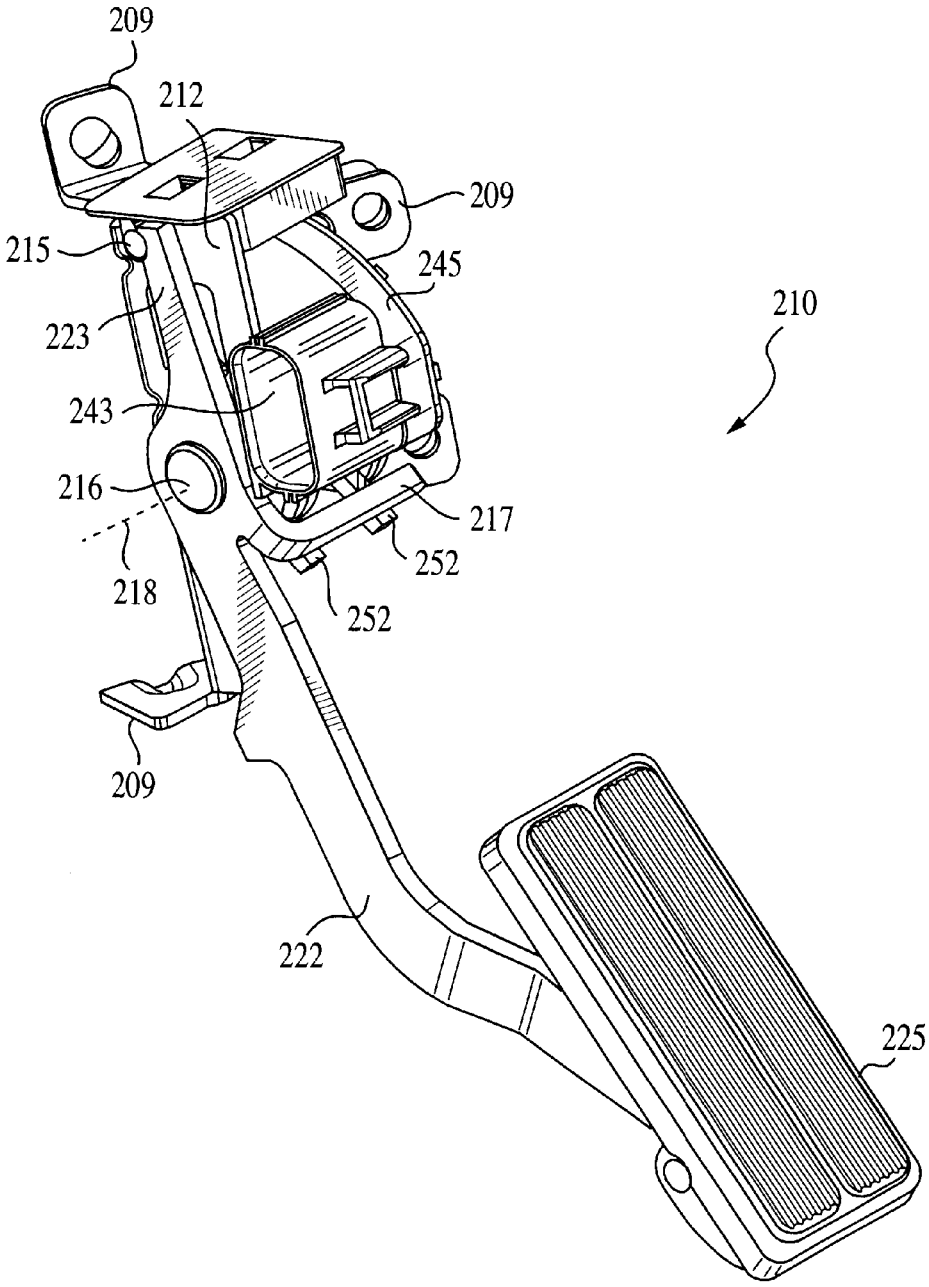
FIG. 21 is a perspective view of a manual control apparatus in accordance with another embodiment of the invention.

As presented in FIGS. 18, 19 and 20, the recesses 188 are provided with slots 196, and the bosses 190 are provided with ears 198 that are received within the slots 196. The slots 196 and ears 198 assist in assembly. During assembly, the bosses 190 are slid into the recesses 188 with a rotation that presses the ears 198 into the slots. This movement rotates the stop pin hole 124 toward the bottom panel 196 of the base 112 until it aligns with the stop pin 115, after which the stop pin is inserted into the stop pin hole 124. 'Referring now to FIGS. 21–25, a throttle control pedal according to another embodiment of the present invention is depicted. In this embodiment, as shown in FIG. 21, the throttle control pedal includes a pedal lever 222 with a pivotably attached foot rest 225, also known as a pedal pad, which is attached at the bottom end of the pedal arm lever. The upper portion of the pedal lever 222 is connected to a pivot shaft 216. The pivot shaft extends along an axis of rotation 218 into a sensor housing 245. The housing 245 is shown fixed in a base 212 that includes several flanges 209 for bolting against the firewall of a passenger compartment in a motor vehicle. The sensor housing 245 includes a socket 243 for the electrical wiring harness connector. The upper end of the pedal lever 222 includes an upper extension 223, or finger, that abuts against a stop pin 215 at the rest position of the pedal. The pedal lever 222 also includes a cross bar 217 that extends parallel to the axis of rotation 218. The cross bar 217 abuts against a pair of friction element protuberances 252 that engage torsion springs circling the pivot shaft 216. Upon rotating the pedal lever 222, the cross bar 217 forces the protuberances 252 against the torsion springs. This increases the load on the friction elements against opposing friction surfaces that increases the hysteresis and resistance to movement of the pedal.

Figure 22:
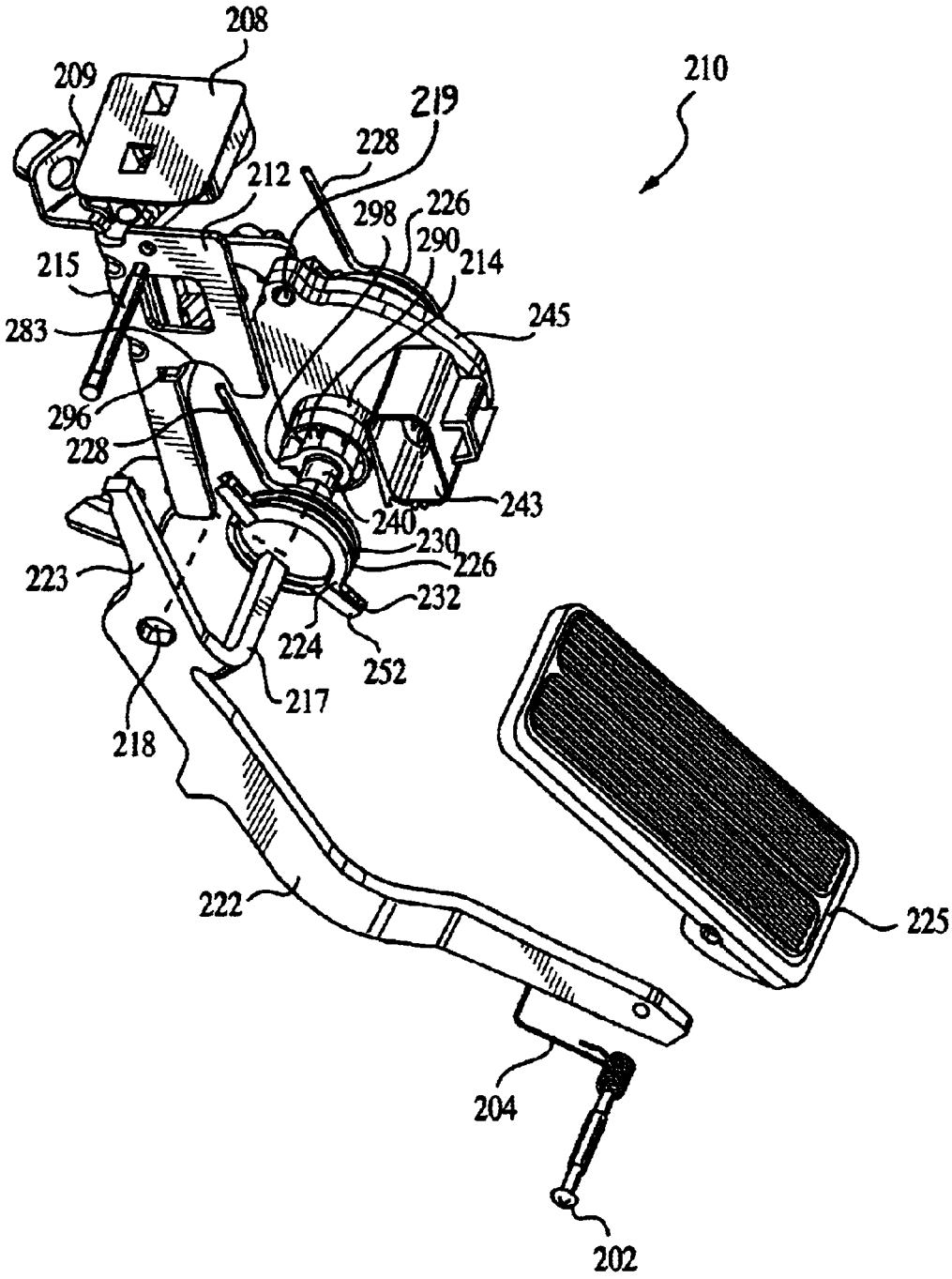
FIG. 22 is an exploded perspective view of the manual control apparatus of FIG. 21.

Referring now to FIG. 22, an exploded perspective view of the throttle control pedal 210 of FIG. 21 is shown. The footrest 225 is pivotally connected to the bottom of the pedal lever 222. A pivot pin 202 is received within a bias spring 204 that biases the footrest 225 in a rest position up against the foot of the driver. The upper end of the pedal lever 222 has an opening for receiving the shaft 240 to connect in the line of the axis of rotation 218 of the pedal lever. The upper end of the pedal arm 222 also includes an extension 223 or finger that abuts against a stop pin 215. The stop pin extends across the top of the base 212 and is also received in the opening 219 of the housing 245 to secure the housing to the base. A cap 208 fits over the top of the base 212.

The throttle control pedal 210 includes friction elements 224 and torsion springs 226 on either side of the sensor housing 245. The friction elements 224 are in a shoe configuration having protuberances 252 extending from near opposite sides of the shoe. The torsional springs 226 wind around the friction elements. The first end 228 of the torsion spring extends upward to engage the upper end of the base 212. The second end 232 of the torsion spring is received within a channel in the protuberances 252 of the friction element. The intermediate portion 230 of the torsion spring 226 is disposed over the center of the friction ring 224. The torsional spring 226 and friction element 224 are disposed around the hub 214, or curved friction surface, of the sensor housing 245. The torsion spring 226 has a inside diameter larger than the outside diameter of the housing hub 214 so that the friction element 224 rubs against the hub, but the torsion spring 226 does not rub against the hub. The pedal arm has a cross bar 217 that extends across the protuberances 252 in a line parallel with the axis of rotation 218. The cross bar 217 contacts the protuberance 252 to be directly coupled therewith, thereby rotating the friction element when the pedal arm is rotated.

The hubs extending from both sides of the sensor housing 245 include opening bosses 290 and one ear 298. The opening boss 290 is received in the recess 288 in the base 212. The ear 298 fits into the slot 296 in the base. Thus, the sensor housing 245 is secured to the base 212 by three points of alignment: at the recess 188, the slot 196 and the stop pin 215.

Figure 23:
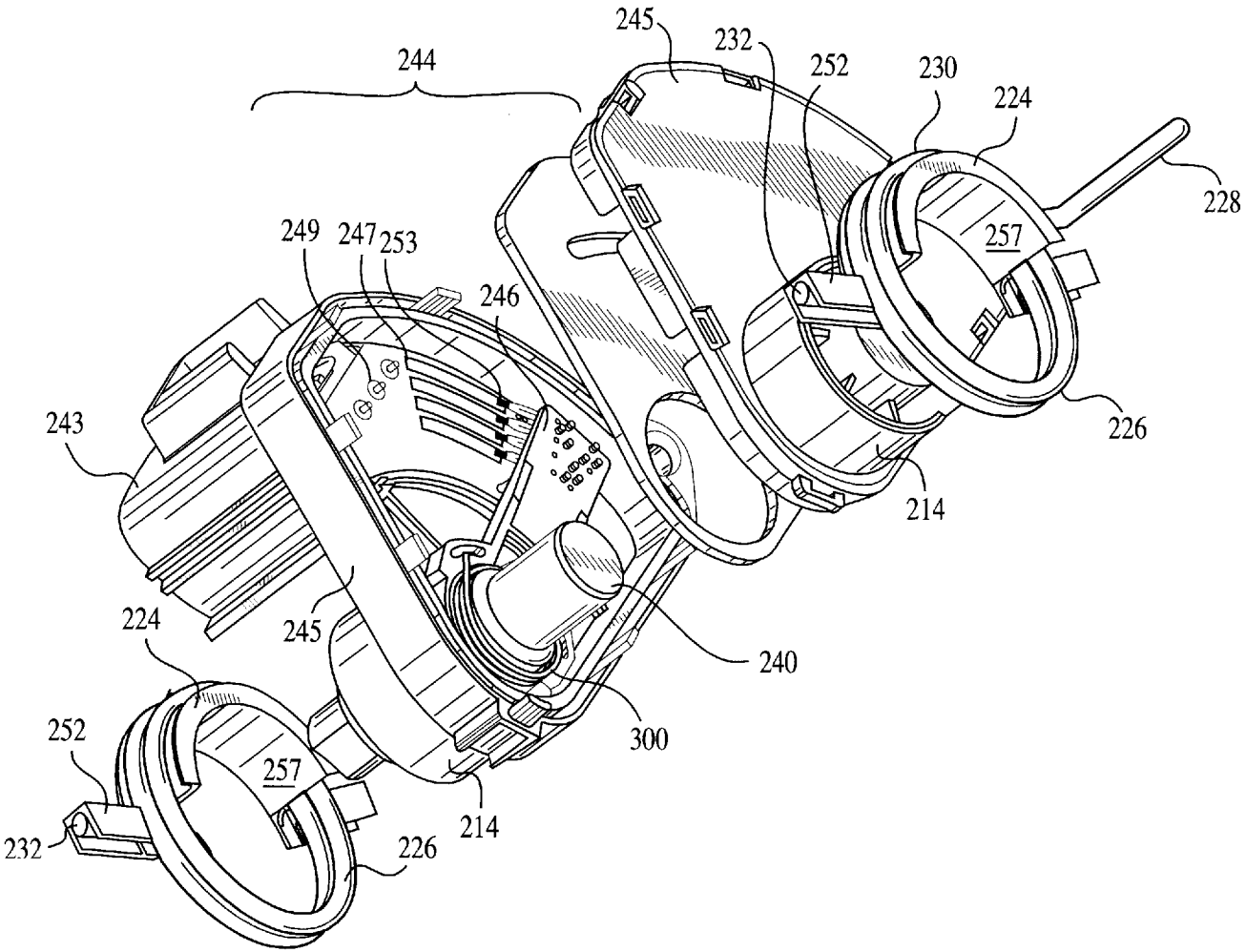
FIG. 23 is an exploded perspective view of the sensor and friction elements of FIG. 21.

FIG. 23 depicts an exploded detailed view of the sensor housing 245, its internal components and the friction elements 224. The position sensor 244 includes a rotor 246 engaging the pivot shaft 240. An internal bias spring 300 biases the pivot shaft and rotor to a rest position. The rotor includes electrical brushes 253 in electrical contact with electrical resistive traces 247. The resistive traces may provide the functionality of both a potentiometer for sensing the angular rotation of the pivot shaft 240 as well as providing an idle validation electrical signal for an engine throttle control system. The resistive traces 247 are connected to the sensor terminals 249 and extend into the wiring harness connector socket 243. As can be seen in this view, the friction elements 224 are positioned around the curved friction surface 214. The inside surface 257 of the friction elements 224 have a radius of curvature greater than the outside radius of the hub 214, so that there is primarily a single point of contact against the friction surface 214 near the middle of the friction element.

Figure 24:
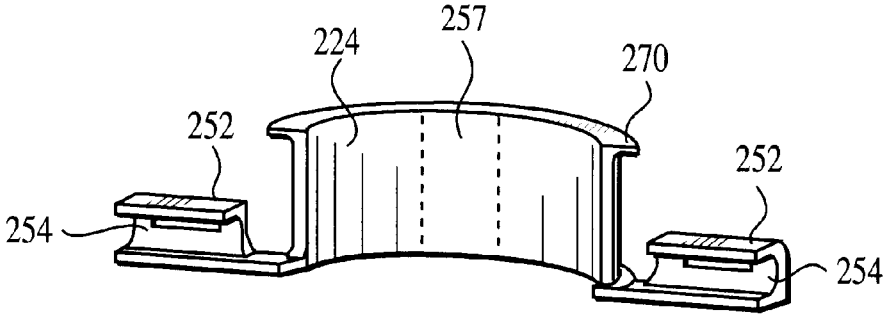
FIGS. 24 and 25 are perspective views of the friction element of FIG. 23.
Figure 25:
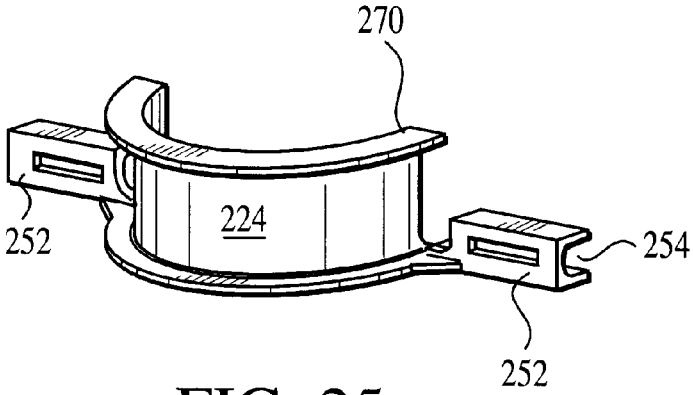

The friction elements 224 are shown in more detail in FIGS. 24 and 25. The friction element 224 is depicted in a shoe configuration. The shoe has a protuberance 252 extending from each end at about 160 degrees apart. Although only one protuberance on each friction element is used to engage the torsion spring 226, having a protuberance at each end is useful to have a bidirectional friction element that can be used interchangeably on either the left outboard or right outboard side of the housing 245. This reduces tooling and inventory costs. The protuberance 252 includes a channel 254 for receiving the torsion springs. The friction element also includes a rim 270 to provide for radial stiffness of the friction element. The stiffness prevents the friction element from wrapping around the curved friction surface 214, thus maintaining a minimal point of contact between the center portion 257 of the inside surface of the friction element with the opposing portion of the friction surface 214. The point of contact will be determined by the additive reaction forces on the first and second ends of the springs.

According to a preferred embodiment, approximately 50% of the force applied to the pedal during depression is resisted by hysteresis, the balance by the springs. The base is formed from metal, cast or stamped, and is covered with a coating having good dry lubricating properties, such as zinc dichromate or epoxy paint. The bearings are self-lubricating and are press fit into the housing. Porous metal or plastic bearings impregnated with oil are desirable. The housing may be formed from a reinforced plastic, injected molded, such as a 30% glass filled polyester. The friction elements may be formed from plastic, such as polyacetol or a fluorpolymer, preferably unreinforced by fiber. The rotor may be formed from plastic and is preferably integrally molded onto the shaft. The sensing element is preferably a ceramic substrate thick film resistance element.

Two biasing/hysteresis return springs are preferably provided. The hysteresis force is directly generated by the springs, so that if one spring breaks, that spring ceases to generate hysteresis. Thus, the total hysteresis is always proportional to the spring return force.

According to a further aspect of the invention, with reference to FIGS. 1–25 and the description provided herein with respect to those figures, a manual control apparatus is provided, comprising:

a base;

a pivot mounted to said base that defines an axis of rotation spaced from said curved friction surface;

a rotatable member coupled to said pivot, wherein said rotatable member is rotatable around said axis of rotation relative to said base;

an angular position sensor comprising a housing fixed to said base and coupled to said pivot to sense rotation thereof;

a stop fixed to said housing; and, a spring coupled to said rotatable member and said base, said spring biasing said rotatable member against said stop.

According to a further aspect of the invention, a manual control apparatus is provided, comprising:

a base comprising a pair of recesses;

a pivot mounted to said base that defines an axis of rotation;

a rotatable member coupled to said pivot, wherein said rotatable member is rotatable around said axis of rotation relative to said base;

an angular position sensor comprising a housing coupled to said pivot to sense rotation thereof, said housing comprising a pair of opposing bosses that are received within said recesses;

a stop coupled to said housing and said base thereby retaining said bosses within said recesses; and, a spring coupled to said rotatable member and said base, said spring biasing said rotatable member against said stop.

According to a further aspect of the invention, a manually operable throttle control is provided, comprising:

a base;

a manually operable control lever for controlling a throttle position;

an electrical sensor for sensing the angular position of said lever and for outputting an electrical signal related to said lever position;

a shaft rotatably mounted on said base and drivingly connecting said lever with said sensor, said sensor and said shaft being relatively rotatable;

a pin securing said sensor on said base and fixing the rotational position of said sensor relative to said shaft and said lever.

Said pin may include a portion forming stop engagable by said lever to limit the rotation of said lever, and said lever includes a surface engagable with said stop portion of said pin.

Said base may include a pair of spaced apart flanges, said sensor may includes a through-hole therein, and said pin passes through said through-hole and is secured to said flanges.

Said pin may include an extension on one end thereof extending outwardly beyond one of said flanges, and said stop portion is defined on said pin extension.

At least one torsion spring may be wrapped around said drive shaft, said spring having a free end engaging pin whereby to restrain said spring against rotation about said drive shaft.

According to a further aspect of the invention, a manually operable throttle control is provided, comprising:

a base;

a manually operable control lever displaceable for controlling a throttle position;

an electrical sensor for sensing the displacement position of said lever and for outputting an electrical signal related to said lever position;

a shaft carried on said base and connecting said lever with said sensor; and, a locating pin carried on said base for locating the rotational position of said sensor relative to said displacement position of said lever.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

What is claimed is:

1. A manual control apparatus, comprising:

a base;

a curved friction surface coupled with said base;

a pivot coupled with said base that defines an axis of rotation spaced from said curved friction surface;

a rotatable member coupled to said pivot, wherein said rotatable member is rotatable around said axis of rotation relative to said base;

a friction element directly coupled to said rotatable member, spaced from said axis of rotation, and forcible against said curved friction surface; and, a spring having a first end, a second end, and an intermediate portion between said first end and said second end, said first end being coupled to said base, said second end being coupled to said rotatable member;

wherein rotation of said rotatable member forces said intermediate portion against said friction element resisted by said curved friction surface thereby generating a frictional resistance to said rotation.

2. The apparatus of claim 1, wherein said pivot comprises a shaft received within a bearing, said bearing being mounted to said base and said shaft being mounted to said rotatable member.

3. The apparatus of claim 2, further comprising an angular position sensor mounted to said base that senses angular position of said shaft.

4. The apparatus of claim 2, further comprising an angular position sensor mounted to said base comprising a rotor coupled to said shaft.

5. The apparatus of claim 1, wherein said friction element is a shoe.

6. The apparatus of claim 1, wherein said friction element is a ring.

7. The apparatus of claim 1, wherein said curved friction surface is cylindrical about said axis of rotation.

8. The apparatus of claim 1, wherein said curved friction surface is cylindrical about said axis of rotation and said friction element is a ring encircling said curved friction surface.

9. The apparatus of claim 1, wherein said spring is a torsion spring encircling said axis of rotation.

10. The apparatus of claim 1, wherein:

said curved friction surface is cylindrical about said axis of rotation;

said friction element is a ring encircling said curved friction surface; and, said spring is a torsion spring encircling said friction element.

11. The apparatus of claim 10, wherein said torsion spring is spaced from said frictional element except at said intermediate portion.

12. A throttle control pedal, comprising:

a housing having a curved friction surface;

a pivot mounted to said housing, the pivot defining an axis of rotation spaced from said curved friction surface, said curved friction surface being cylindrical about said axis of rotation, said pivot comprising a shaft received within a bearing mounted to said, housing;

a lever coupled to said shaft;

a friction element directly coupled to said lever disposed on said curved friction surface and forcible against said curved friction surface; and, a torsion spring encircling said friction element and having a first end, a second end, and an intermediate portion between said first end and said second end, said second end being coupled to said lever;

wherein rotation of said lever forces said intermediate portion against said friction element resisted by said curved friction surface thereby generating a frictional resistance to said rotation.

13. The throttle control pedal of claim 12, wherein said friction element comprises at least a sector of an outside cylindrical surface and a protuberance extending therefrom, said protuberance having a channel that receives said second end of said spring.

14. The throttle control pedal of claim 13, wherein said outside cylindrical surface comprises a spacer having a predetermined thickness and said protuberance extends from said spacer, and said protuberance and said spacer fixing said torsion spring relative to said friction element in an unstressed state such that a space is defined between said torsion spring and said friction element encircling said friction element and interrupted by said spacer.

15. The throttle control pedal of claim 13, wherein said outside cylindrical surface comprises a spacer having a predetermined thickness and said protuberance extends from said spacer, said protuberance and said spacer coupling said torsion spring relative to said friction element in an unstressed state such that a space is defined between said torsion spring and said friction element encircling said friction element and interrupted by said spacer, and upon rotating said lever said intermediate portion of said spring is forced into contact with said friction element, thus interrupting said space at another location.

16. The throttle control pedal of claim 12, wherein said friction element is a shoe wrapping about halfway around said curved friction surface.

17. The throttle control pedal of claim 12, wherein said friction element is a ring encircling said curved friction surface.

18. The throttle control pedal of claim 12, wherein said friction element further comprises a protuberance that engages said second end of said torsion spring.

19. The throttle control pedal of claim 18, wherein said lever further comprises a bar proximate to said protuberance, said bar in contact with said protuberance and each rotate concentric with the axis of rotation.

* * * * *